US005195226A

United States Patent [19]

Bornancini

[11] Patent Number: 5,195,226

[45] Date of Patent: Mar. 23, 1993

[54] SEMI AUTOMATIC PISTOL

[75] Inventor: José C. M. Bornancini, Porto Alegre, Brazil

[73] Assignee: Forjas Taurus S/A, Rio Grande Do Sul, Brazil

[21] Appl. No.: 392,607

[22] Filed: Aug. 11, 1989

[30] Foreign Application Priority Data

Nov. 3, 1988 [BR] Brazil ..... PI 8805801

[51] Int. Cl.[5] ..... B23P 13/00

[52] U.S. Cl. ..... 29/1.1; 228/173.6

[58] Field of Search ..... 29/1.1, 463; 228/173.6; 42/71.02, 75.03; 89/194, 195, 196, 197

[56] References Cited

U.S. PATENT DOCUMENTS 1,840,512 1/1932 Kling ..... 29/463

FOREIGN PATENT DOCUMENTS 8706070 6/1988 Brazil .

388116 10/1921 Fed. Rep. of Germany ..... 29/1.1

OTHER PUBLICATIONS

U.S. Patent Application, Serial No. 931,287, filed Nov. 17, 1986, by Larry Cowles et al.

*Primary Examiner*—Joseph M. Gorski

*Attorney, Agent, or Firm*—Bachman & LaPointe

[57] ABSTRACT

The invention pertains to a method of manufacturing a semiautomatic pistol, wherein the pistol frame is made by cutting, stamping, folding and welding a metal sheet, and then the working parts of the pistol are assembled with the frame.

6 Claims, 9 Drawing Sheets

SEMI AUTOMATIC PISTOL

BACKGROUND OF THE INVENTION

This invention relates to the manufacture of semi-automatic pistols, preferentially in 0.22 caliber, or the type that uses that kind of ammunition, of annular percussion, destined to sportive use or target practice, whose frame is obtained by assembling a monocoque profile developed and cut onto a steel-sheet plane.

STATE OF THE ART

Semi-automatic pistols have their basic structure or frame made from a solid metallic body, forged or cast.

Such a piece needs to a heavy machining to meet all the mechanical characteristics necessary to the fine working of the arm. The basic frame of the arm must be drilled to permit the introduction of the magazine and the barrel, as well as to contain every part of the functioning mechanism like the trigger and the hammer, and must also be drilled to provide the necessary holes for pins and pivots, and machined to make the guides for the bolt (movable breech). These operations are multiple and very expensive, and more than 70% of the material of the original block is wasted in the form of metal chips.

Solutions have been proposed, like in the standard model of the Ruger pistol, that, since 1948, shows the lower part of the frame and the handle in two halves, stamped in metal sheet and welded along the edges, where an upper tubular component is lodged to hold the barrel and the bolt, duly fastened by a very complex mechanism, introduced through the handle.

Another known piston is the Austrian STEIR gun which has the lower part of the frame made in two stamped and welded halves having the breech box movable within the frame guides.

More recently, in Brazilian application PI 8706070 of Oct. 11, 1987, an automatic piston having a frame made by metal stamping, aiming at making its production easier at reduced cost was disclosed.

On the said frame, several sub-assemblies members are mounted, in this way providing the modular assembling of the gun.

The frame and the associated sub-assemblies are encased into a body that covers all the movable parts during the operation, except the trigger. No details are revealed in connection with the process to make the said body.

OBJECT OF THE INVENTION

It is the main object of this invention to reduce manufacturing costs and improve the mounting of a semi-automatic pistol by the use of stamped metal sheet, in which the complete pistol frame, including the bolt housing, its lower part, and the handle form a single part made from a metal sheet, further cut, stamped, folded and welded.

Another object of this invention is to provide a lighter and stronger piston frame by starting from a steel sheet into which the whole frame is cut along its peripherical line, further stamped and folded into a two-halves body and finally closed through welding so as to attain a totally rigid body.

SUMMARY OF THE INVENTION

As a first step, a metal sheet is cut with the developed plane of the piston frame, comprising the left side and the right side thereof, linked by the upper planified part of the bolt housing. After having been cut by stamping every necessary detail, the sheet is drawn and the sides are folded forming the bolt housing of the hand gun.

The sides are connected along the stamped edges and are welded by a top joint.

Thus, the frame or the monocoque of the piston is made with a totally rigid body and its working optimized through the welding process, because its two sides belong to the same folded plate.

Inside this empty frame of the piston, the barrel is first fastened and then guided into the bolt housing through the fastening and actuating system. In the same way, all other driving parts of the trigger are introduced, and finally the magazine is lodged being guided by the lower part of the handle.

The sights have relatively fixed positions located one in the barrel and the other on the frame, without need of any movable parts, in opposition to what happens in most of known pistols.

The handle has two external grips made of plastic or hardwood fastened with screws.

The advantages and technical results of the invention will become evident from the detailed description that follows, referring to the drawings annexed hereto in which:

FIG. 1—is a right hand elevational side view of the assembled semi-automatic piston of this invention;

FIG. 2—is a left hand elevational side view of the pistol of FIG. 1;

FIG. 3—is a perspective view of the developed frame of the pistol cut into a plane steel sheet;

FIG. 4—is a perspective view of the sheet of FIG. 3, showing cuts, holes and edges of the frame;

FIG. 5—is a perspective view of the sheet of FIG. 4, after folding;

FIG. 6—is a partially exploded perspective view of FIG. 1;

FIG. 7—is an enlarged view of the bolt stop plate;

FIG. 8 and 9—are sectional details to show the dissabling of the bolt;

FIG. 10—is an elevational section of the right hand side of FIG. 1;

FIG. 11—is an elevational section of the left hand side of FIG. 1;

FIG. 12—is a sectional view of the bolt, by the AA' line of FIG. 11;

FIG. 13—is a perspective lower view of the bolt;

FIG. 14—is an exploded view of the bolt.

DETAILED DESCRIPTION OF THE INVENTION

Figure 1:
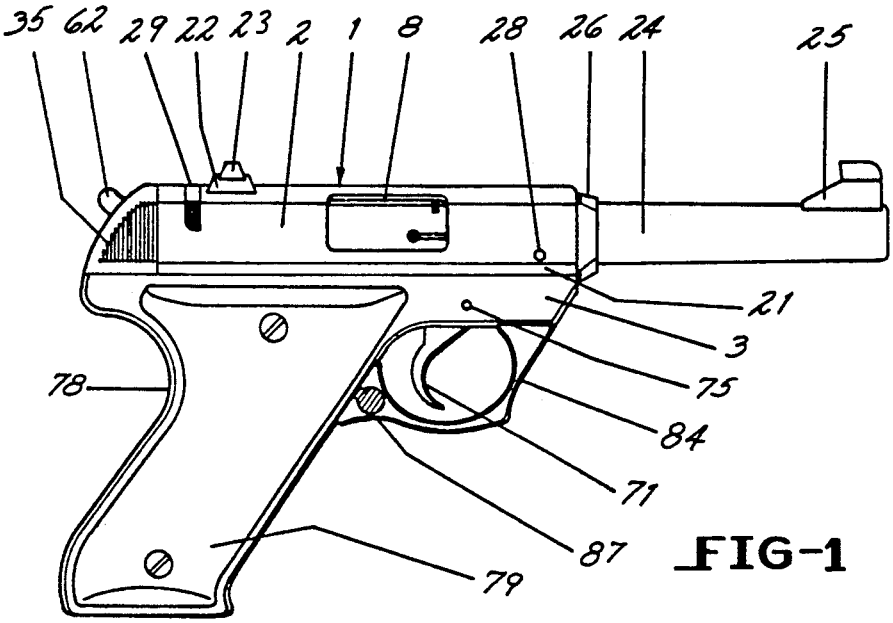
Figure 2:
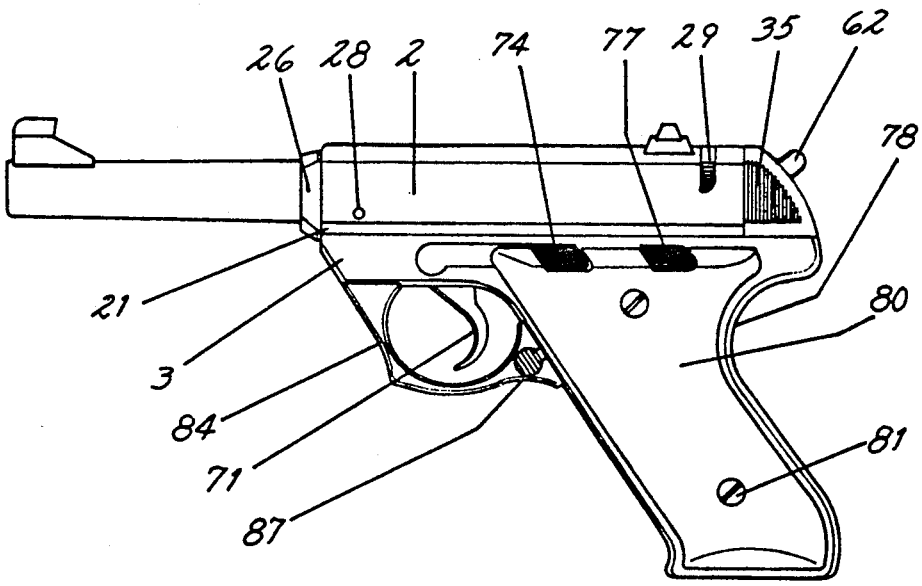

FIGS. 1 and 2 show respectively the right and left hand sides of the above mentioned pistol.

The pistol is formed by a frame (1) whose body (2) or bolt housing is linked with its lower part (3) by two 40° angled lower bolt guide tracks (21) that allow the transition between the body (2) and the lower part (3) and of the guides to the lower part of the bolt, said lower bolt having a support extending down into the handle (78), that one side covered by the right (79) and left (80) grips, fastened by the grip screws (81).

The frame (1) has its barrel assembly port (13), (see FIG. 5) introduced and fixed to the barrel (24) and its base (26) by the fixing pin (28) and in its bolt port (12), the bolt (34), whose serrated grips (35), acting as the bolt activator are protruded.

In addition, in the upper part of the frame, near its back portion, there is the bolt stop plate (29).

From the bolts serrated grips (35) stick out the hammer (62).

The front sight (25) is fixed to the barrel (24) and the rear sight (23) by way of its base (22), is fixed to the upper part of the frame body (2).

The trigger guard (84) is fixed to the lower bolt housing support (3) and to the front side of the handle, being provided close to its the release button (87) of the cartridge magazine (88).

The trigger (81) is protected by the trigger guard (84), that has in the front part a cavity to support the left hand forefinger when the piston is held with both hands.

On the right hand side of the frame is located the ejection port (8).

On the left hand side of the pistol, above the left hand grip (80) are located the bolt catch and release level 24, and the safety lever (77).

The mechanism of the hand gun is entirely encased in said frame (1) formed by the frame body (2), its lower part 93) and the handle, and is, therefore, completely shielded from dust and dirt.

Figure 3:
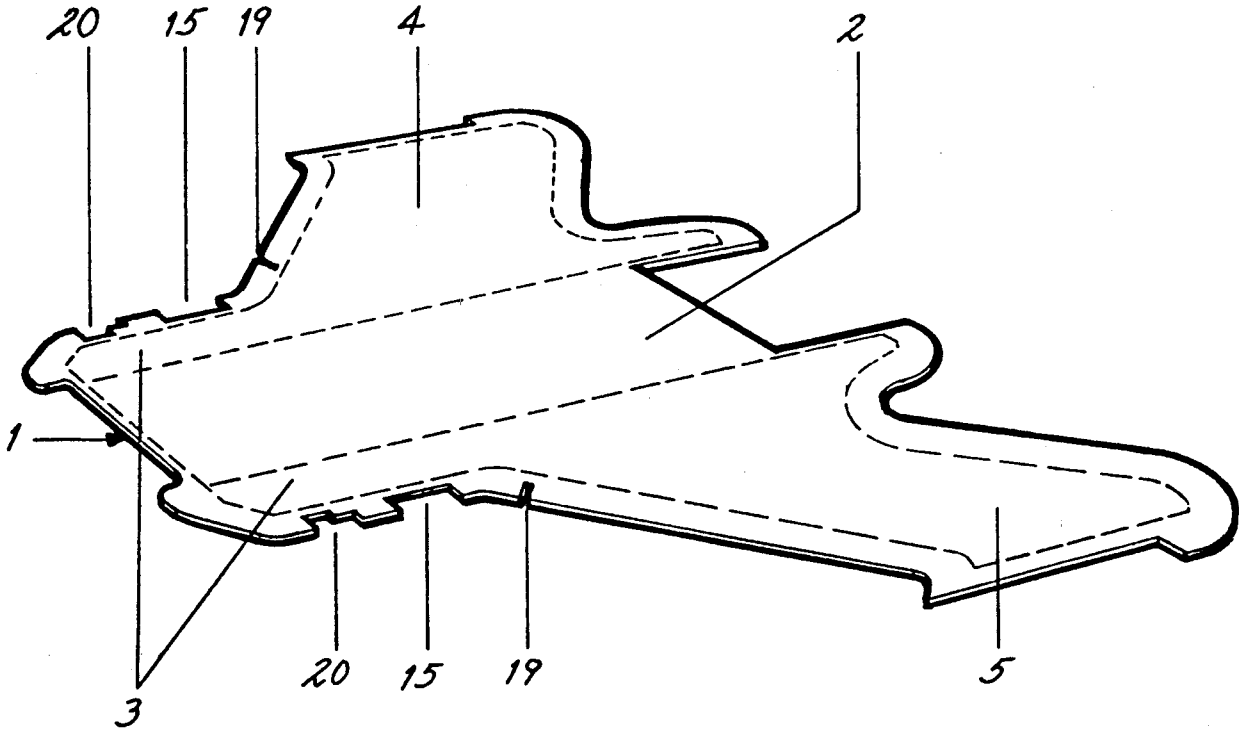
Figure 4:
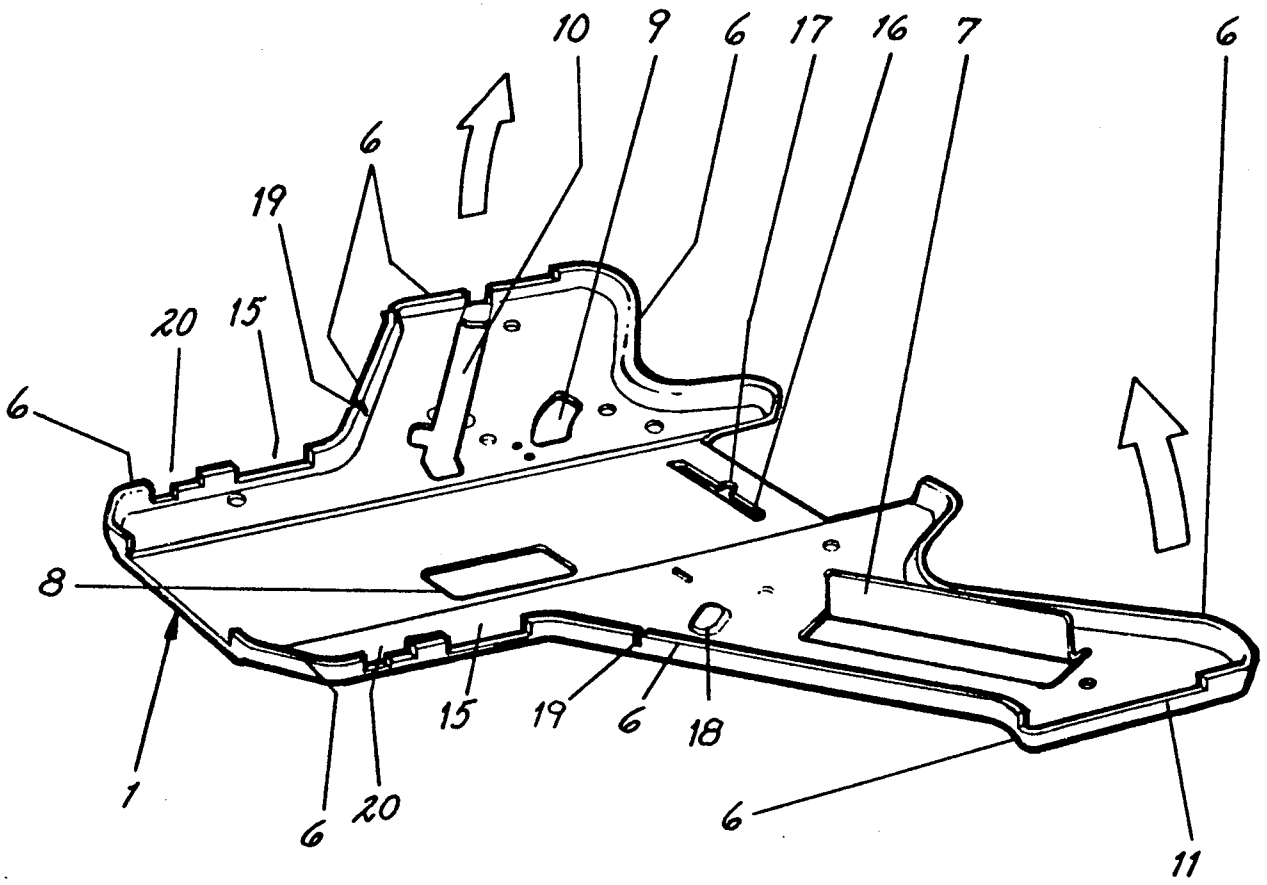
Figure 5:
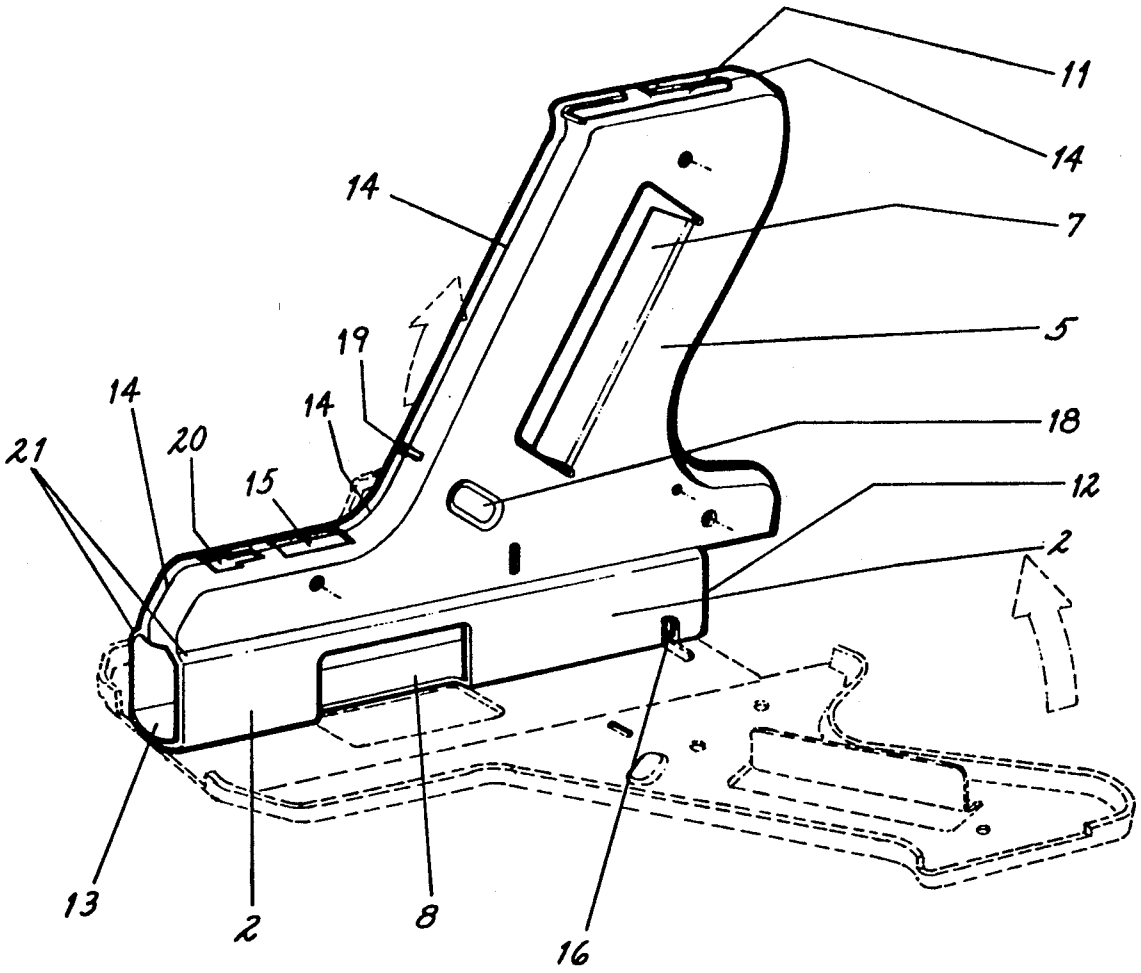

The process of making this closed monocoque structure is better illustrated in FIGS. 3, and 4 and 5, where we can see the frame construction sequence.

The process of manufacture like in FIG. 3, begins by the cutting of a metal sheet profile that corresponds to the whole piston frame (1), comprising the surfaces that will result in the frame bolt housing (2), its lower bolt housing support (3), in the handle on left (4) and right (5) sides, and small symmetric cuttings of the edges, like edges (20), (15), and (19).

Further in, as seen on FIG. 4, a stamping operation takes place that results in the formation of the stamped and folded edges (6) and in several cuttings, like the ejection port (8), the magazine follower button slot (10), the magazine guide (7), the safety slot (9), the bolt stop plate slot (16), and others of the required holes and slots.

In a further operation, FIG. 5, the part of FIG. 4 is folded in U shape around the upper face of the frame bolt housing (2), forming the pistol that is then welded, without any material addition, along the lines (14) of the stamped edge profile (6), the forming a monocoque body opening (13) for introducing of the barrel base (26); (12) for bolt (34) displacement; openings (9) for the safety lever (77); (8) for the ejection port; opening (7) for the magazine guide; opening (10) for the magazine follower button slot; opening (11) for introducing the magazine; opening (16) like bolt stop plate slot (25); opening (15) for trigger setting; opening (20) for trigger guard setting; and opening (19) for the magazine release slot.

At it can be seen in FIG. 5, at this stage of manufacture, all the required holes are drilled and aligned to fit therein all pivots, screws, and pins of the mechanism, as well as those stopping slots, and guides needed to actuate the hand gun.

The next stage, of bolt assembling will be better understood from the description of the inverse operation, that is its disassembling.

Figure 6:
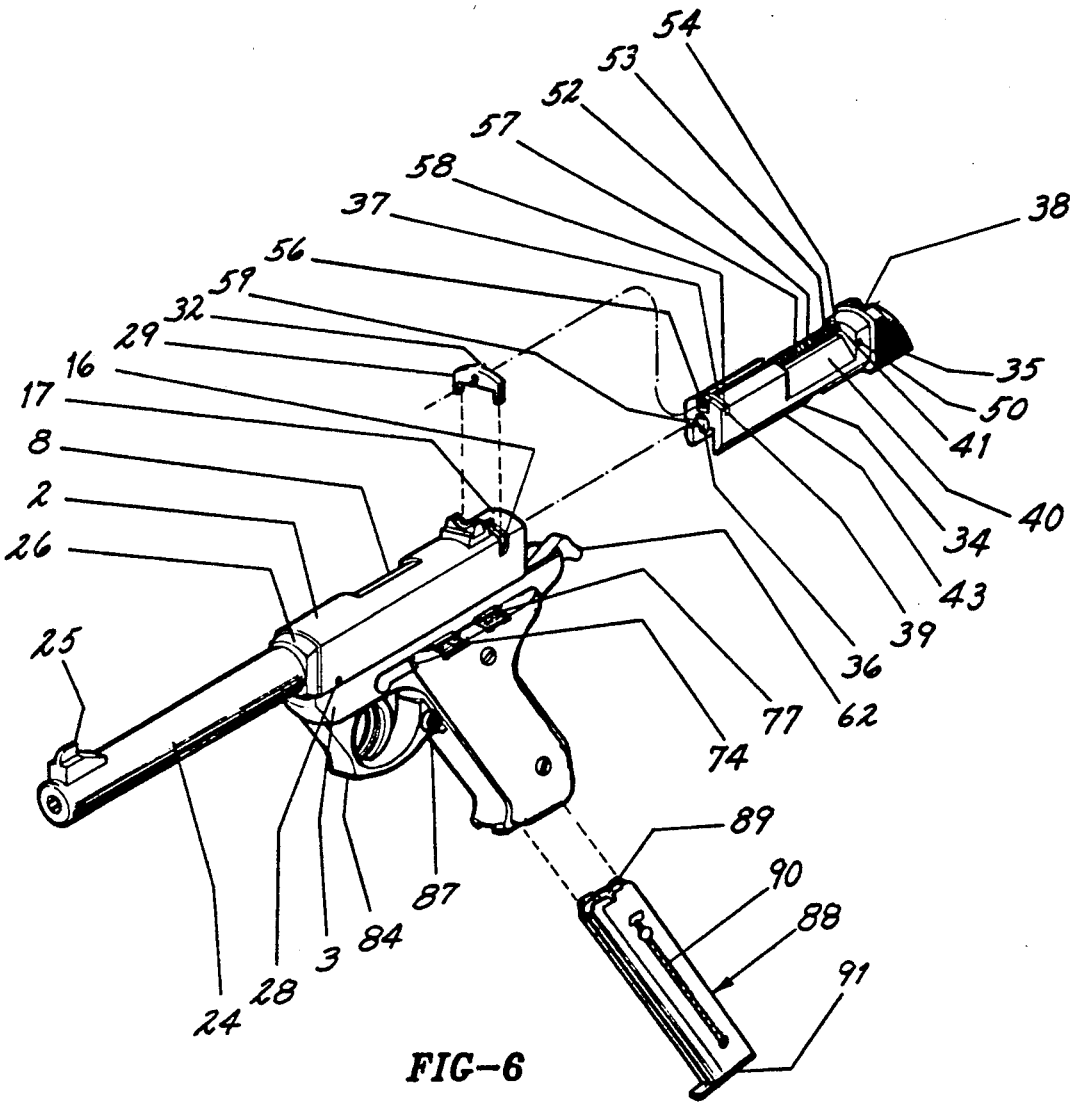
Figure 7:
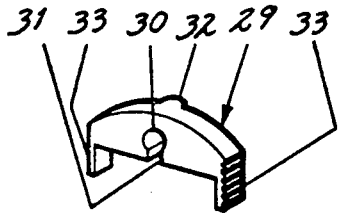

FIG. 6 illustrates the disassembling operation, with removal of the bolt, which is accomplished without the use of any tool which is another advantage of this invention.

Figure 8:
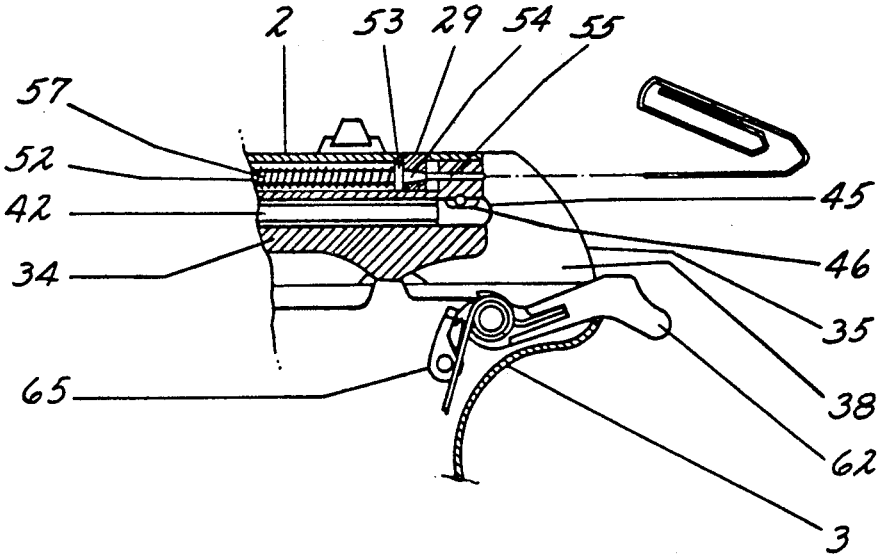
Figure 9:
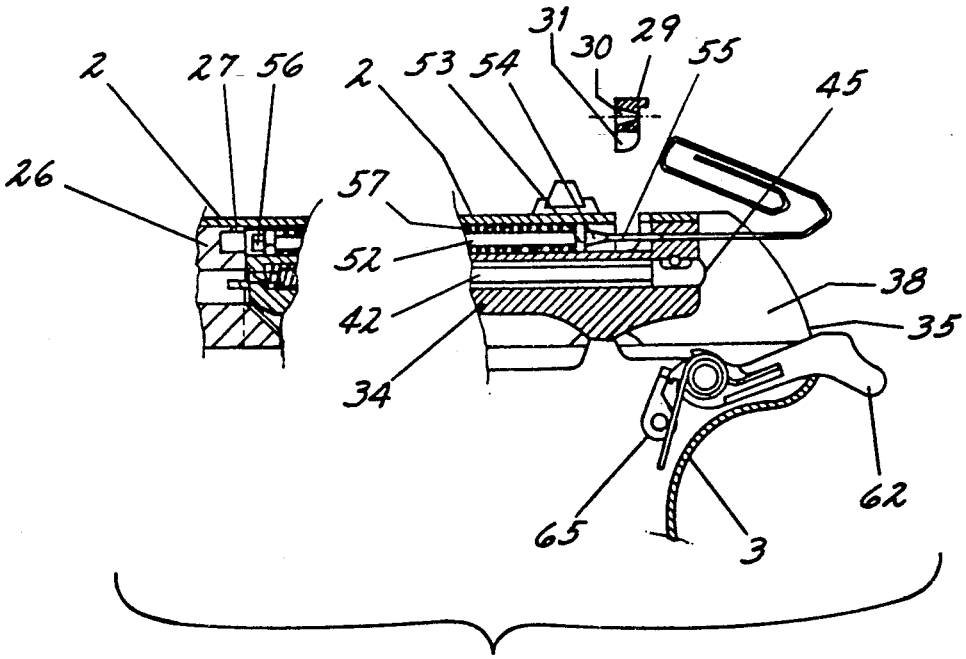

FIGS. 8 and 9 show some more details of the bolt (34) disassembling operation which begins by the cocking of the hammer (62), and then, pushing with a paper clip tip, the end (55) of the recoil spring guide (52). With this, the locator cone (54) of the recoil spring guide is released from the conical stop slot (30) of the bolt stop plate (29). This one may be pulled up by its serrated grips (33), taking it out of the respective holding slot (16), because the bolt stop plate (29) has the lower portion of the slot in conic shape (30) opening to the bolt stop plate assembly, and disassembly slot (31), that allows the sliding of the cylindrical part (55) of the guide (52).

Figure 10:
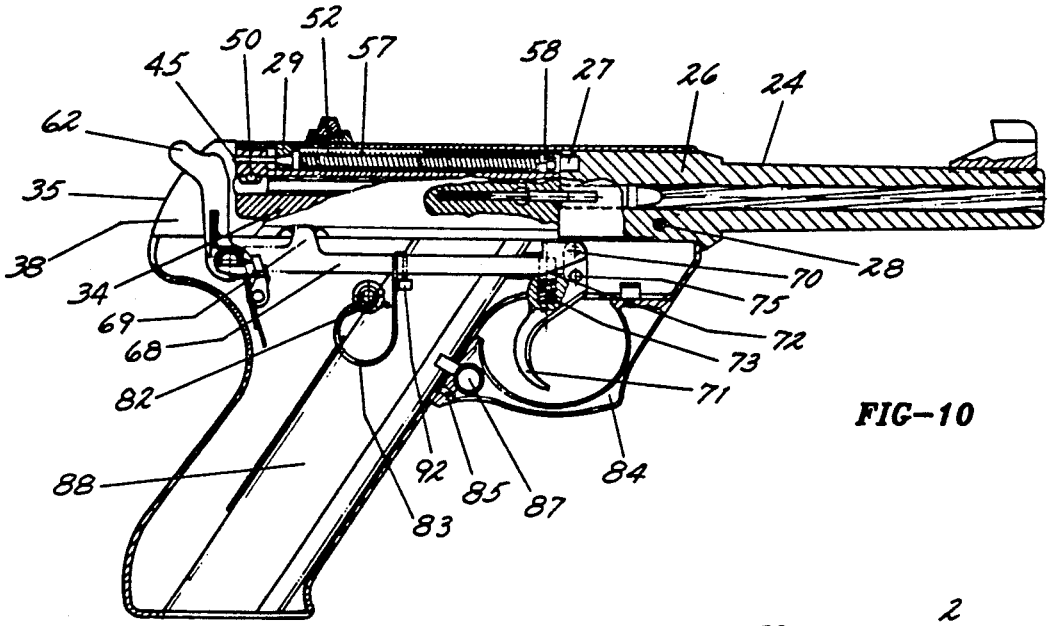

With this extremely simple operation, the bolt remains free and can be removed by the back bolt port (12) from the upper parts (2) of the frame. The bolt comes out with all its components assembled FIG. 10), such as: recoil spring (57) and its guide (52), held in the front part of the bolt by the recoil spring guide retainer (58), fixed in its respective guide spring retainer slot, and in the rear part by the recoil spring guide bolt locator extension hole (41), the firing pin (42) with its spring (51), held in position inside the correspondent bolt hole, by the retainer pin (50), and finally the extractor (59) with its respective pin (60) and spring (61).

The bolt is a monocoque piece with a longitudinal notch (37) for housing and guiding the rod guide (52) and respective recoil spring (57). In its front side, there is provided a recess (36) for the cartridge rim, and in the back, there is the hammer slot (38) for the hammer (62) and the symmetric angled sides (40) for weight reduction. In the back, there are reliefs forming the bolts grips (35).

Figure 12:
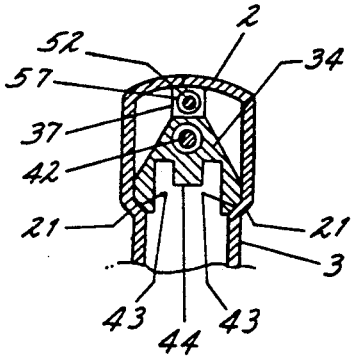
Figure 11:
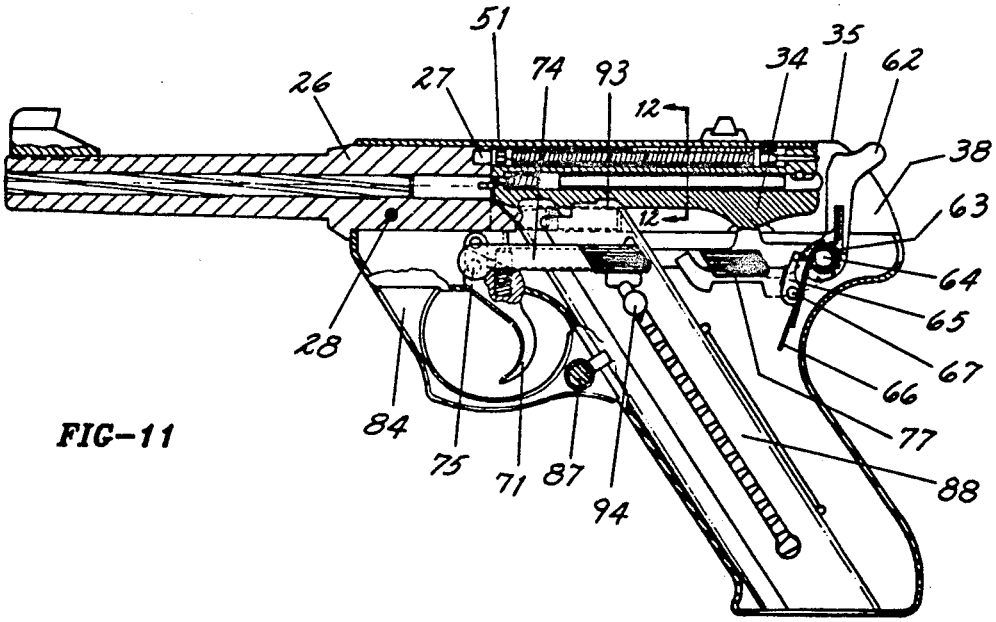
Figure 13:
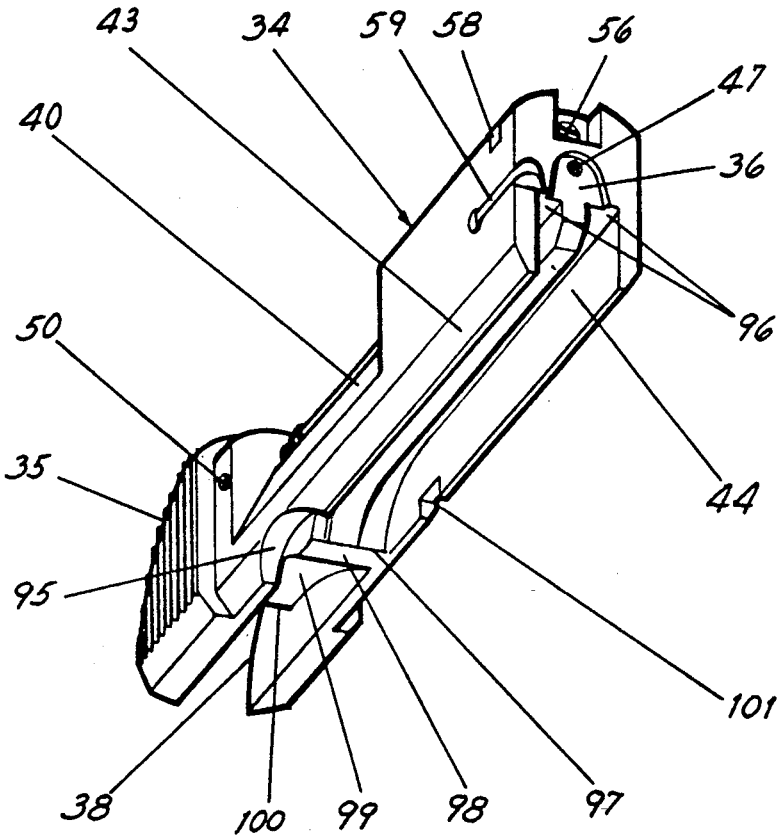
Figure 14:
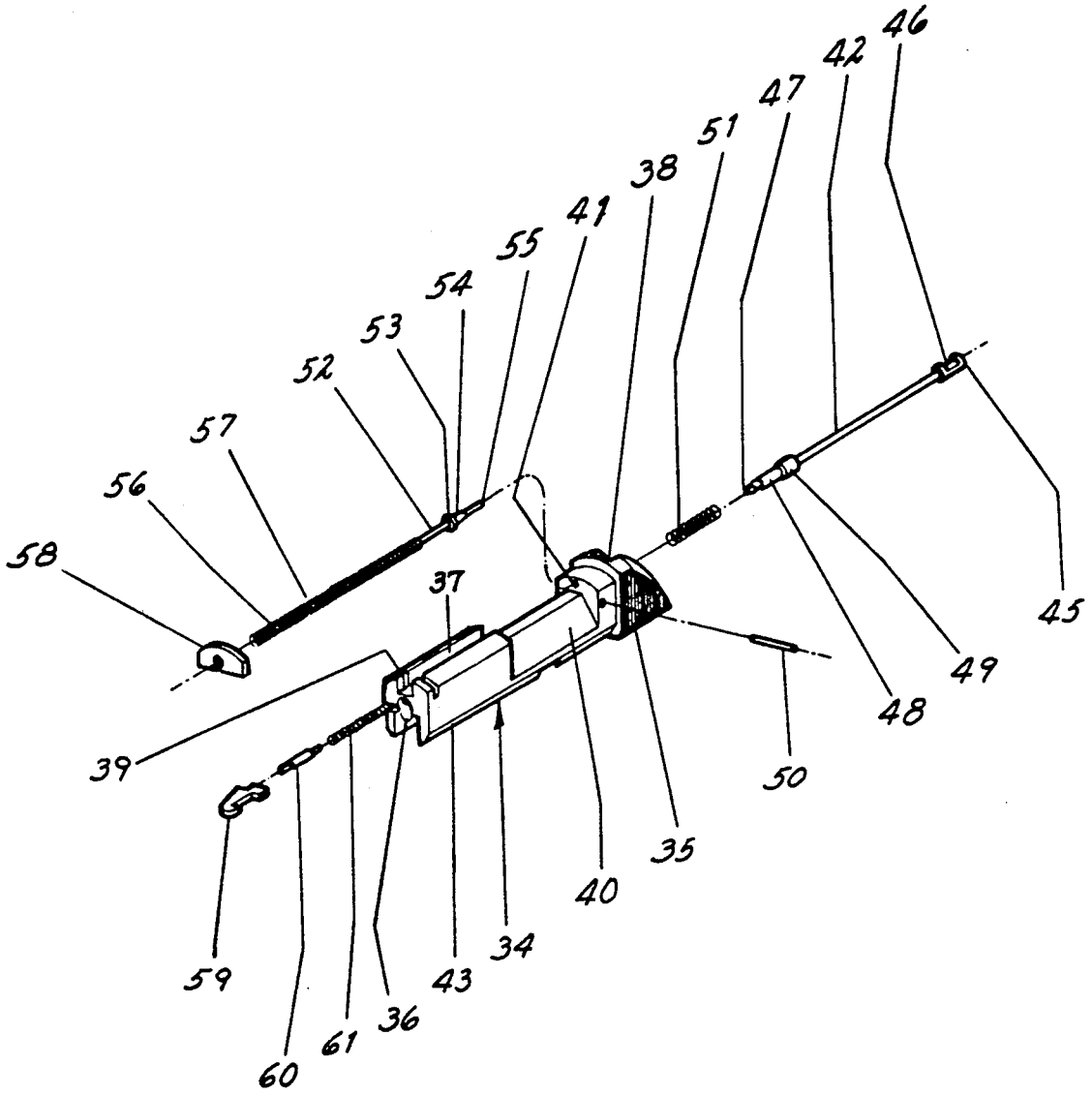

FIG. 12 is a sectional view along line AA' of FIG. 11. In this section, we can seen that the bolt upper part is curved, and is guided by the corresponding curved section of the internal face of the upper part of the frame.

The side faces of the bolt are flat, being limited in its lower part by the angled lower part guides (43) that are guided by the angled lower bolt guide track (21) of the transition of the upper part (2) of the frame for its lower part (3). In the central lower part of the bolt (34), projects downward an alignment magazine rib (44) that permits taking out the cartridges from the magazine. In this part of the bolt (34), we can see the upper face of the recoil spring guide slot (37), and the respective recoil spring (57) and, under the slot (37), the hole housing the firing pin (42).

As we can see, the withdrawal of the bolt from the frame is an extremely simple operation that only requires an inverse operation that is: introducing of the bolt (34), by the port (12) putting the bolt stop plate (29) in position; and pushing ahead the recoil spring guide (52), allowing the complete introduction of the (29) in its slot (16). It is impossible that a mistake occurs during this operation, because its locator (32) must coincide with the bolt stop locator slot (17) of the frame FIG. 4).

It is not intended to give a detailed description of the assembling of the other parts of the hand gun which follows usual practices, having only to stress that the assembling of the barrel (24) is made by the introduction of the barrel base (26) in the front opening (13) of the frame (2) where the pin (25) is fixed.

All remaining parts of the mechanism are assembled through the back opening (12), or by the trigger slot (15) destined to the introduction of the trigger (71), in the lower part of the frame. That last operation is made easier by the withdrawal of the trigger guard (84), loosening the respective screw (85) fixed in the front face of the handle (78), making such trigger guard slide forward to its locator slot (20), that allows its separation from the lower part of the frame (3).

As to the way the pistol works, only a summary will be made, which is a normal procedure in hand guns of this model (unbolted breech), or of a simple blow-back type.

After pulling back the bolt (34) by its serrated grips (35) to its far back position, cocking the hammer (62), this is released returning, by the action of the recoil spring (58), at the same time taking out the cartridge from the magazine (88) and introducing it into the chamber of the barrel (24) base, till the complete closing of the bolt against the base (26). In this way the piston remains ready for the first shot. The trigger is pivoted to the bar (68), so that by pulling it forward against the action of the spring (73), making the side arm of the said bar turn forward the sear (65) the hammer (62) is released, and turns around its pivot pin (64), pressed by the spring (63), and strikes the head (45) of the firing pin (42), against its inertia and the action of the spring (51), thus having the striker (48) striking the cartridge determining its firing.

With the deflagration of the explosive load, the bullet starts to move and during a fraction of a second the bolt (34) is kept closed, by its own inertia and by the action of the recoil spring, till the action of the detonation makes the bolt move backward, which by means of the extractor (59) ejects the fired cartridge.

During said backward movement of the bolt (34), through the disconnector cam (69), of the trigger bar (69), it turns loose said bar from the sear (65), preventing the actuation of the automatism in case of persistence of the pulling of the trigger (71). In its backward movement, the bolt (34) makes the shot cartridge to hit the ejector (93), being so ejected through the port (8).

After the bolt (34) reaches its far back position, drained of all its energy, it is pushed forward by the action of the recoil spring (57). In that forward movement, a new cartridge is taken out from the magazine to feed the hand gun by introducing it into the chamber by means of the corresponding chamber ramp. Then the trigger bar (68) turn upward pressed by the spring (73), thanks to the sliding of the disconnector cam (69) into the bolt (34) trigger bar disconnector cam recess (95). This way, after closing the bolt, a further pressure upon the trigger (71), will make the trigger bar (68) bring into action the sear (65), making another shot.

As a complementary element of the mechanism, a safety lever (77) is foreseen so that on being lifted intentionally, prevents the actioning of the pistol, locking the bolt (34) in the open position.

The boat (34) can only be closed when the catch release lever (74) is intentionally released, or when a full magazine is introduced and the bolt (34) is slightly pulled back and released thereafter.

The pistol may be fired only when the magazine is fully inside its housing, because only then the safety bar (92) will be activated freeing the disengagement spring (83) from the trigger bar (68) that, otherwise, will force it downward, disconnecting from the sear (65), due to its strength being greater than that of spring (73) of the trigger bar.

What we claim is:

1. A process for manufacturing a semi-automatic pistol with a monocoque frame, comprising the steps of:

cutting a profiled portion from a plane metal sheet;

stamping said profiled portion, thereby forming a stamped edge contour along an outer periphery of said profiled portion, and thereby cutting several slots into said profiled portion, wherein said stamped edge contour includes lip portions extending away from the plane of said profiled portion for selected portions of said profiled portion;

folding said profiled portion about an axis thereof such that two opposing sub-portions having complementary profiles are formed wherein selected ones of said lip portions face and abut each other;

welding said sub-portions together along said lip portions facing and abutting each other without any addition of material, thereby producing a hollow monocoque pistol frame including a bolt housing having an opening for a barrel and a handle portion integrally joined to said bolt housing;

inserting a barrel into said opening and fastening said barrel to said bolt housing, such that a portion of said barrel extends from said bolt housing;

introducing a bolt into said port opposite said barrel; and assembling an action and other parts into the hollow monocoque piston frame.

2. The process for manufacturing a semi-automatic pistol with a monocoque frame according to claim 1, wherein said cutting several slots into said profiled portion includes cutting slots corresponding to an ejection port, a magazine follower button slot, a safety slot and a bolt stop plate slot.

3. The process for manufacturing a semi-automatic piston with a monocoque frame according to claim 2, wherein said step of cutting several slots into said profiled portion further includes cutting slots corresponding to a barrel assembly port for introducing and fixing a barrel base, a bolt port for the introduction and sliding of a bolt, a magazine guide, a magazine port, a trigger slot, a trigger guard locator slot, and a magazine release slot.

4. The process for manufacturing a semi-automatic piston with a monocoque frame according to claim 2, wherein:

said barrel includes a base and a front sight;

said fastening step includes passing a pin into said barrel and bolt housing; and said introducing step includes fixing a rear sight base of a drift rear sight in a bolt stop plate slot, and introducing a bolt stop plate in said bolt stop plate slot;

the process further including the steps of:

fixing a trigger guard with a magazine release button in a lower bolt housing support and in a front face of a handle portion;

introducing a magazine through the magazine port in a handle base; and wherein said action and other parts assembly step includes introducing a trigger and a trigger bar in a trigger slot;

providing a trigger bar activator pin spring linked by a pivot pin and a trigger bar activator pin, positioning said trigger in the frame by a trigger pivot pin; and assembling a sear and its respective spring, a hammer and its spring, a safety lever, a bolt catching release lever through the back bolt port of the frame; and fixing right and left grips to the handle portion by screws.

5. The process for manufacturing a semi-automatic pistol with a monocoque frame according to claim 4 further comprising:

keeping the bolt in place with the bolt stop plate which is completely housed in a bolt stop slot after introducing the bolt through the back bolt port of the frame and pushing the bolt forward, matching the bolt stop locator slot with the back bolt stop locator of said bolt stop plate, fixing said stop plate to the frame by introducing and adjusting a locator cone of a recoil spring guide in a conical locator for said recoil spring guide locator cone in the bolt stop plate which is done by pressing a bolt locator rear extension slightly ahead so as to allow the extension to pass through a bolt stop plate assembly and disassembly slot when the bolt stop plate is pressed downward; and permitting the expontaneous recoil of the bolt locator rear extension by the action of a recoil spring, whereby the bolt stop plate remains definitely anchored due to the extension remaining introduced in a hole of a back portion of the bolt.

6. The process for manufacturing a semi-automatic piston a with a monocoque frame according to claim 1, wherein said hollow monocoque pistol frame further includes to angled lower bolt guide tracks and two parts that form a frame lower bolt housing support, and wherein said folding step further forms slots existing between said lip portions facing and abutting each other.

* * * * *